US005414209A

United States Patent [19]

Morita

[11] Patent Number: 5,414,209

[45] Date of Patent: May 9, 1995

[54] ELECTRONIC MUSICAL INSTRUMENT

[75] Inventor: Shigehiro Morita, Hamamatsu, Japan

[73] Assignee: Kabushiki Kaisha Kawai Gakki Seisakusho, Shizuoka, Japan

[21] Appl. No.: 203,566

[22] Filed: Mar. 1, 1994

[51] Int. Cl.[6] ..... G10H 1/06; G10H 1/18; G10H 7/00

[52] U.S. Cl. ..... 84/615; 84/622; 84/645

[58] Field of Search ..... 84/615–620, 84/622–625, 645

[56] References Cited

U.S. PATENT DOCUMENTS

| | | | |
|---|---|---|---|
| 5,020,410 | 6/1991 | Sasaki | 84/622 X |
| 5,142,959 | 9/1992 | Sakamoto et al. | 84/645 |
| 5,206,446 | 4/1993 | Matsumoto et al. | 84/615 X |
| 5,252,775 | 10/1993 | Urano | 84/645 |

*Primary Examiner*—Stanley J. Witkowski

[57] ABSTRACT

Disclosed is an electronic musical instrument comprising keyboard operators for generating keyboard data; panel operators for generating tone control data; memory means for storing the tone control data; switch means for changing a normal mode to an interrupt mode, and vice versa; control means for, when tone control data is produced in accordance with an operation of the panel operators, writing the tone control data into the memory means in the normal mode, and inhibiting the tone control data from beings written into the memory means in the interrupt mode; a tone generator for, when keyboard data is produced in accordance with an operation of the keyboard operators, producing a tone signal based on the keyboard data and the tone control data stored in the memory means; and transmission means for generating transmission data according to tone control data when the tone control data is produced in accordance with an operation of the panel operators and transmitting the transmission data outside the electronic musical instrument, and generating transmission data according to keyboard data when the keyboard data is produced in accordance with an operation of the keyboard operators and transmission means for transmitting the transmission data outside the electronic musical instrument.

8 Claims, 6 Drawing Sheets

ELECTRONIC MUSICAL INSTRUMENT

BACKGROUND OF THE INVENTION AND THE RELATED ART

The present invention relates to an electronic musical instrument capable of independently transmitting only a MIDI message.

Recent electronic musical instruments, such as an electronic piano, an electronic organ and a synthesizer, have a function to transmit and receive MIDI messages. In such an electronic musical instrument, data, which is generated by operating keys on a keyboard or switches on a control panel, is supplied to a tone generator to be used to generate musical tones, or is converted to data in a format conforming to MIDI standards (this data will be called "MIDI message") and is then sent outside the electronic musical instrument. A MIDI message externally sent to the electronic musical instrument is supplied to the tone generator and is used to generate musical tones.

Many recent electronic musical instruments have an automatic performance function. The use of this automatic performance function permits a player to enjoy playing an instrument by playing a specific part while automatically playing several parts. For instance, while generating musical tones of accompaniment parts, such as a drum part, a base part and a chord part, by using the automatic performance function, the player can play a melody part with the timbre of a trumpet.

This automatic performance function is accomplished in the following manner. Automatic performance data, stored part by part in a memory of a sequencer externally connected to the electronic musical instrument or in a memory of the electronic musical instrument, and is sequentially read out from the memory, is sequentially sent to individual tone generators associated with the respective parts. The tone generators simultaneously produce tone signals based on which the associated musical tones are generated. To accomplish the automatic performance function, therefore, the same number of the tone generators as the number of the parts is required. The provision of the tone generators equal in number to the parts increases the cost, so that a multi-tone generator, which will simultaneously generate the musical tones of a plurality of the parts, has been developed and become popular recently.

One of those multi-tone generators, called a multi-timbre tone generator can efficiently perform the automatic performance, and thus becomes very popular. The multi-timbre tone generator can generate a plurality of timbres at a time, and can arbitrarily select an oscillator that will be assigned to the tone generation of each part. In other words, in the multi-timbre tone generator, each oscillator is not assigned previously to each of the parts, but the number of the oscillator to be assigned to each part is determined and also it is determined what numbered oscillator is assigned, when tone generation is requested, and thus such multi-timbre tone generator has an advantage in permitting the effective use of a limited number of the oscillators.

In preparing the aforementioned automatic performance data of a plurality of the parts, for example, a scheme called "over dubbing" is used. In the "over dubbing", automatic performance data of a specific part is prepared first and recorded, and then automatic performance data of another part is prepared and recorded while generating musical tones based on the previously recorded automatic performance data of the specific part. Thereafter, the above operation is repeated to sequentially prepare automatic performance data of all the necessary parts and record the data.

FIG. 6 illustrates an example of the system structure which executes the over dubbing. In FIG. 6, reference numeral "50" denotes a keyboard equipped with a tone generator which becomes a "master", reference numeral "51" denotes a sequencer, and reference numeral "52" denotes, for example, a multi-timbre tone generator unit which becomes a "slave". The MIDI output terminal of the keyboard 50 is connected to the MIDI input terminal of the sequencer 51. The MIDI output terminal of the sequencer 51 is connected to the MIDI input terminal of the keyboard 50 and the MIDI input terminal of the tone generator unit 52.

In preparing automatic performance data and recording the data using this system structure, first, a player sets the keyboard 50 to a local OFF mode. Then, the player operates the keyboard 50 to play a specific part of a piece of music, for example, a bass part. Accordingly, a MIDI message is output from the MIDI output terminal of the keyboard 50 and is supplied to the sequencer 51. In the sequencer 51, the received MIDI message is stored on a specific track (e.g., the first track) and the received MIDI message is echoed back to the keyboard 50. The echo back causes the same data as the MIDI message stored in the sequencer 51 to be supplied to the tone generator of the keyboard 50, thereby generating musical tones.

When the preparation and recording of automatic performance data of the specific part are completed in the above manner, the sequencer 51 is activated. Consequently, the MIDI message of the specific part previously recorded on the first track in the sequencer 51 is transmitted to the tone generator unit 52, which in turn generates musical tones.

While listening the thus generated musical tones of the specific part, the player then performs an operation to prepare and record automatic performance data of another part. More specifically, as the player plays the keyboard 50, a MIDI message is output from the MIDI output terminal of the keyboard 50 and is supplied to the sequencer 51. In the sequencer 51, the received MIDI message is recorded on a different track (e.g., the second track) from the first track, and is echoed back to the keyboard 50. The echo back causes the tone generator of the keyboard 50 to generate musical tones based on the same data as the MIDI message stored in the sequencer 51. At this time, the generation of musical tones according to the MIDI message recorded on the first track from the tone generator unit 52 continues.

Thereafter, automatic performance data of the individual parts are prepared and are sequentially recorded on the respective tracks in the sequencer 51 until the preparation and recording of automatic performance data of all the parts are finished. Accordingly, the preparation and recording of automatic performance data of one piece of music are completed.

According to the conventional electronic musical instrument, when an event on a predetermined switch on the control panel (e.g., a timbre switch, a volume switch, etc.) is detected, tone control data (data for controlling the characteristic of a musical tone, such as a timbre number for determining the timbre or the volume value for determining the volume), which corresponds to the event-detected switch, is produced and is stored in a predetermined memory. At the same time, a MIDI message associated with that switch (e.g., a program change message, a control change message, etc.) is produced and sent outside the electronic musical instrument.

When the depression of a key on the keyboard is detected, generated is a musical tone having the pitch corresponding to the depressed key and having the timbre, volume, etc. based on the tone control data stored in the memory, and, at the same time, a MIDI message (note-ON message) corresponding to the key-depression event is produced and sent outside the electronic musical instrument. When the release of a key on the keyboard is detected, tone off of the musical tone, which is currently being generated and is associated with the released key, is carried out. At the same time, a MIDI message (note-OFF message) corresponding to the key-release event is produced and is sent outside the electronic musical instrument.

Because the conventional electronic musical instrument has the above-described structure, in changing the timbre of a musical tone to be generated by the tone generator unit 52, in the over-dubbing system shown in FIG. 6, the operation mode of the sequencer 51 should be set to the mode for outputting a MIDI message, which has been inputted to the MIDI input terminal, directly to the MIDI output terminal, and the timbre switch on the keyboard 50 should be operated to generate a program change message and to send the program change message outside the electronic musical instrument. Consequently, the program change message is supplied to the tone generator unit 52 through the sequencer 51 to permit the alteration of the timbre of the musical tone that is generated from the tone generator unit 52.

When the timbre switch on the keyboard 50 is operated, however, the tone control data (timbre number) stored in the aforementioned memory is also changed. This changes the timbre of the musical tone which is being generated from the tone generator incorporated in the keyboard 50. Accordingly, the timbre of the musical tone which is generated from the tone generator incorporated in the keyboard 50 may become different from what is intended by the player, so that the over dubbing with the timbre intended by the player cannot be carried out.

OBJECT AND SUMMARY OF THE INVENTION

It is therefore an object of the present invention to provide an electronic musical instrument with an excellent operability, which can independently send a MIDI message outside the electronic musical instrument to alter the status of an external tone generator without affecting a tone generator incorporated in the instrument.

To achieve the above object, an electronic musical instrument according to the present invention has a structure as shown in FIG. 1 and comprises keyboard operators for generating keyboard data; panel operators for generating tone control data; memory means for storing the tone control data; switch means for changing a normal mode to an interrupt mode, and vice versa; control means for, when tone control data is produced in accordance with an operation of the panel operators, writing the tone control data into the memory means in the normal mode, and inhibiting the tone control data from being written into the memory means in the interrupt mode; a tone generator for, when keyboard data is produced in accordance with an operation of the keyboard operators, producing a tone signal based on the keyboard data and the tone control data stored in the memory means; and transmission means for generating transmission data according to tone control data when the tone control data is produced in accordance with an operation of the panel operators, and transmitting the transmission data outside the electronic musical instrument, and generating transmission data according to keyboard data when the keyboard data is produced in accordance with an operation of the keyboard operators, and transmitting the transmission data outside the electronic musical,instrument.

According to the present invention, when this electronic musical instrument is set in a normal mode by the switch means, the control means acts as if it is switched on and tone control data produced by the operation of the panel operators is sent to the memory means to be stored therein, as shown in FIG. 1. When this electronic musical instrument is set in an interrupt mode by the switch means, the control means acts as if it is switched off, to inhibit the tone control data, produced by the operation of the panel operators, from transmitting into the memory means. Therefore, the tone control data stored in the memory means will not be altered even if the panel operators are operated. This means that even the operation of the panel operators will not affect the tone generator at all in an interrupt mode. The transmission means produces a MIDI message and sends it outside the electronic musical instrument, regardless of whether the instrument is in the interrupt mode or in the normal mode.

When a panel operator is operated in an interrupt mode, therefore, a MIDI message associated with this panel operator can be sent outside the electronic musical instrument without affecting the tone generator. For instance, according to the conventional electronic musical instrument having a local ON/OFF function, when a panel operator or a keyboard operator is operated in a local OFF mode, a MIDI message associated with that event is sent outside the electronic musical instrument without activating the tone generator incorporated in the instrument. The tone generator incorporated in the instrument is called an "internal tone generator", hereinafter. Since the tone control data stored in the memory means is changed according to that event, however, the internal tone generator will be affected. According to the present invention, a MIDI message is sent outside the electronic musical instrument without altering the tone control data stored in the memory means, so that the internal tone generator will not be influenced at all. Even in the case where musical tones are being generated while receiving a MIDI message in a local OFF mode, therefore, the electronic musical instrument of the present invention, when set in an interrupt mode, can send a desired MIDI message outside the electronic musical instrument whenever necessary, regardless of the musical tone signals that are generated by the internal tone generator. The electronic musical instrument of the present invention is thus excellent in operability.

According to a first preferred embodiment of the present invention, the transmission data may be a MIDI message prepared in conformity to MIDI standards. If a tone generator to be externally connected to this electronic musical instrument has a MIDI interface, it is possible to control the characteristics of musical tones this tone generator will generate, irrespective of the type of the tone generator.

According to a second preferred embodiment of the present invention, the tone control data produced in accordance with the operation of a panel operator may be data for instructing a timbre change, and the transmission means may produce transmission data for instructing a timbre change based on the tone control data, and may transmit the transmission data outside the electronic musical instrument. Accordingly, the timbre of a musical tone generated from, for example, a tone generator, which is externally connected to this instrument, can be altered without affecting the timbre of a musical tone generated by the internal tone generator.

According to a preferred modification of the second preferred embodiment of the present invention, the transmission data, which is generated by the transmission means and is to be sent outside this electronic musical instrument, may be a program change message prepared in conformity to MIDI standards. If a tone generator to be externally connected to this electronic musical instrument has a MIDI interface, it is possible to control the characteristics of musical tones this tone generator will generate, irrespective of the type of the tone generator.

According to a third preferred embodiment of the present invention, the switch means may comprise a switch for changing the normal mode to the interrupt mode, and a switch for changing the interrupt mode to the normal mode. This design allows a mode change from the normal mode to the interrupt mode or vice versa by a single operation, so that this electronic musical instrument has an excellent operability.

According to a fourth preferred embodiment of the present invention, the switch means may comprise a switch for changing the normal mode to the interrupt mode or the interrupt mode to the normal mode in accordance with the depression of that switch. This design has an advantage in that a mode change between the normal mode and the interrupt mode can be accomplished by a single switch.

According to a fifth preferred embodiment of the present invention, the control means may be a CPU (Central Processing Unit).

According to a sixth preferred embodiment of the present invention, the transmission means may be constituted of a CPU and a MIDI interface circuit.

DESCRIPTION OF THE PREFERRED EMBODIMENT

An electronic musical instrument according to one embodiment of the present invention will be described in detail below with reference to the accompanying drawings. The following description is centered on the structure and operation of the portion which accomplishes only the transmission of a MIDI message without affecting a tone generator incorporated in this electronic musical instrument.

Figure 1:
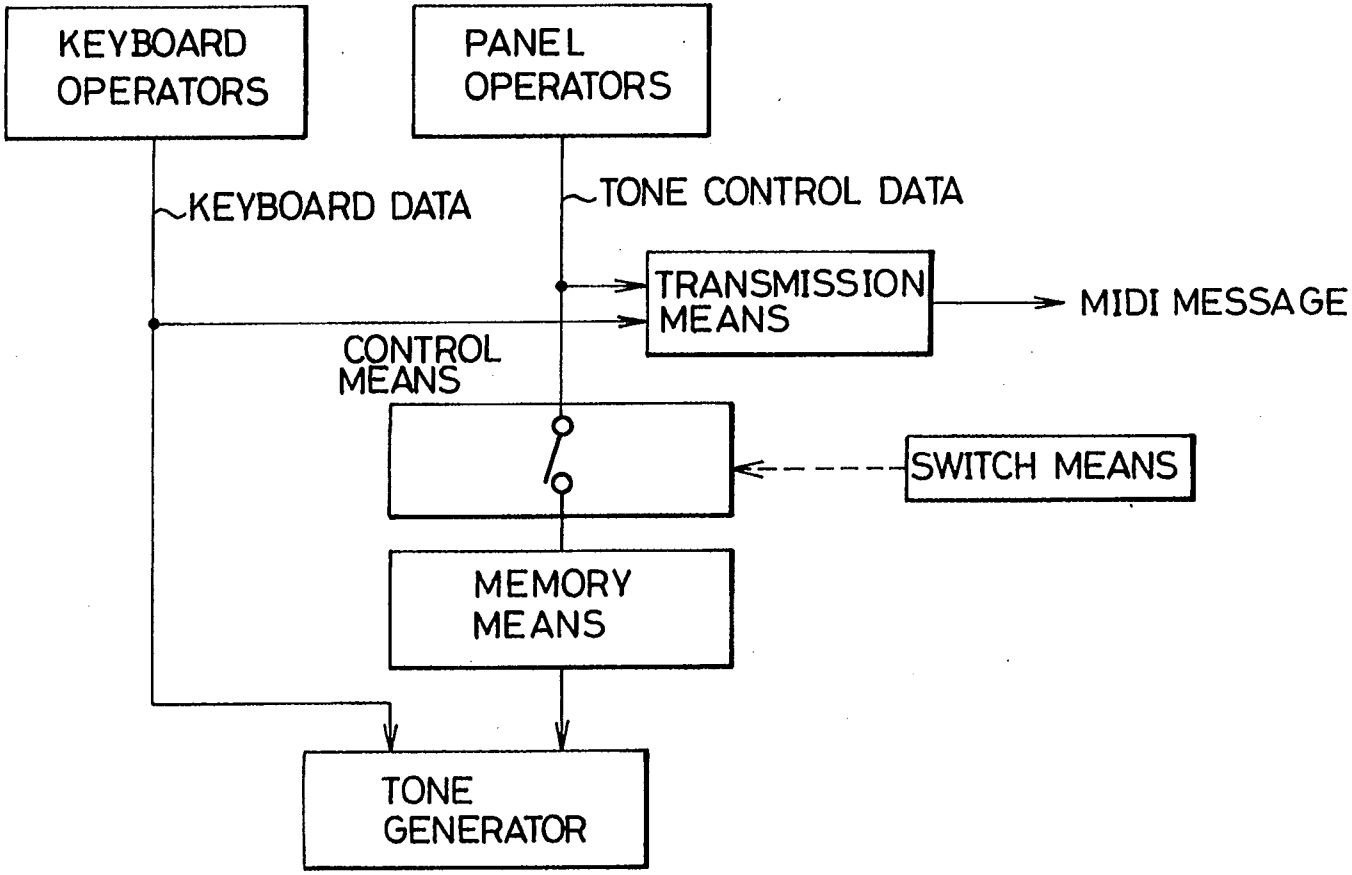
FIG. 1 is a diagram for explaining the structure of an electronic musical instrument embodying the present invention.
Figure 2:
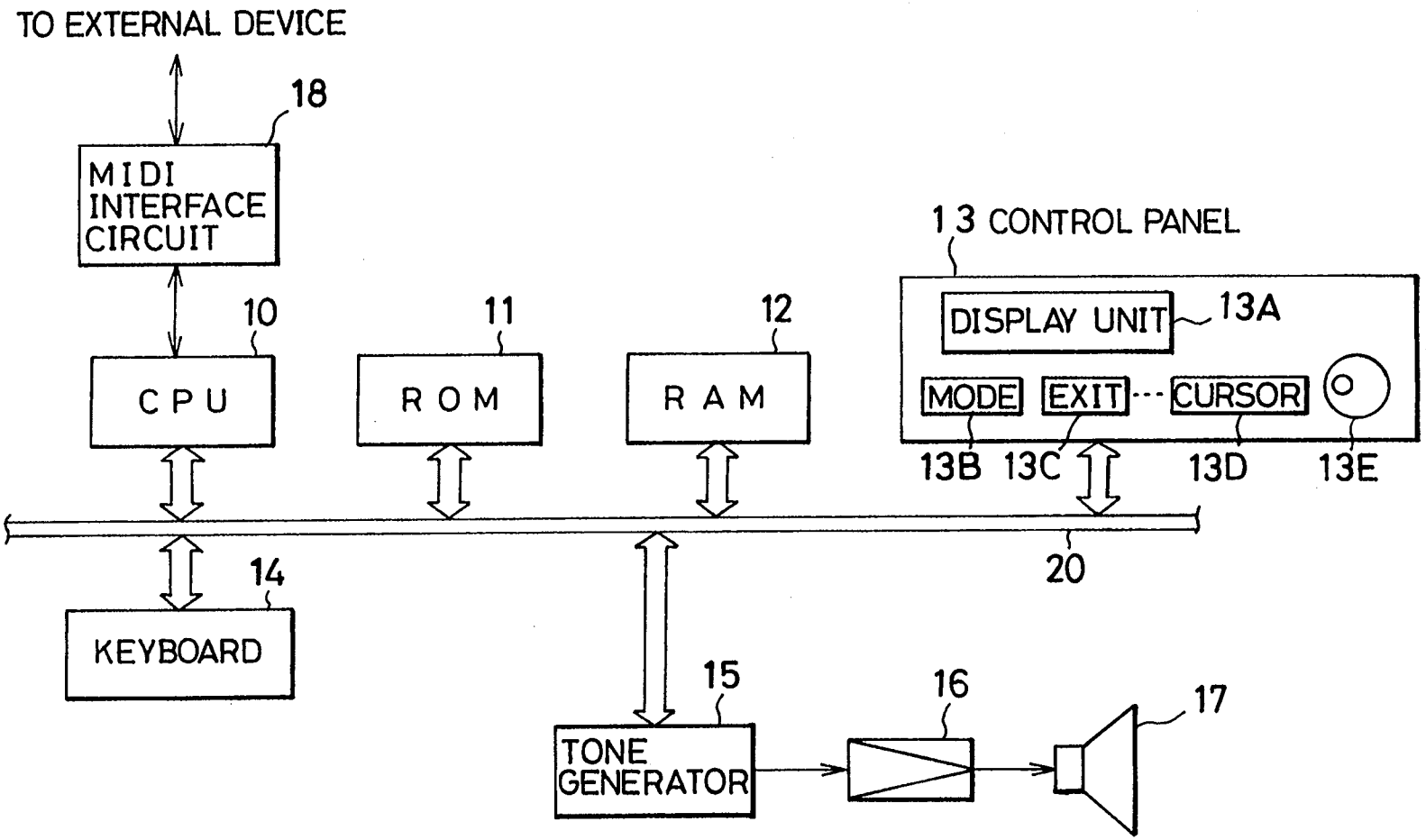
FIG. 2 is a block diagram illustrating a schematic structure of an electronic musical instrument according to one embodiment of the present invention.

FIG. 2 presents a block diagram showing the schematic structure of an electronic musical instrument according to the embodiment of the present invention. This electronic musical instrument comprises a CPU 10, a ROM 11, a RAM 12, a control panel 13, a keyboard 14 and a tone generator 15, which are mutually connected by a system bus 20.

The control means of the present invention is constituted of the CPU 10. The CPU 10 performs the general control of the electronic musical instrument in accordance with a control program stored in the ROM 11. For example, the CPU 10 performs a tone ON/OFF process in accordance with the operation of the keyboard 14, and various processes, such as a timbre changing process and a volume changing process in accordance with the operation of the control panel 13. A MIDI interface circuit 18 is connected via a special line to this CPU 10.

The transmission means of the present invention comprises the CPU 10 and the MIDI interface circuit 18. The MIDI interface circuit 18 serves to control the exchange of MIDI data between the electronic musical instrument and an external device. The external device may be another electronic musical instrument, a sequencer or a personal computer, which are designed to process a MIDI message.

Stored in the ROM 11 are the aforementioned control program to control the CPU 10 and various types of fixed data the CPU 10 uses in various processes. The ROM 11 also holds timbre parameters for determining the timbres of musical tones to be generated and automatic performance data for performing an automatic performance. The contents of the ROM 11 are read out by the CPU 10 via the system bus 20. More specifically, the CPU 10 reads out the control program (instructions) from the ROM 11, decodes and executes the control program, and reads out the predetermined fixed data for various processes.

The CPU 10 reads out a timbre parameter, which corresponds to a timbre number stored in a timbre buffer, from the ROM 11 and sends the timbre parameter to the tone generator 15 to thereby determine the timbre of the musical tone that is to be generated by this electronic musical instrument. The CPU 10 also reads out the automatic performance data from the ROM 11 via the system bus 20, converts the automatic performance data into data which the tone generator 15 can interpret, and sends the converted data via the system bus 20 to the tone generator 15 to conduct an automatic performance.

The memory means of the present invention is constituted of the RAM 12. The RAM 12 temporarily stores various types of data that are used to execute the control program, and has various areas, such as a data buffer, a register and a flag, defined therein. Those areas include the aforementioned timbre buffer and a volume buffer which store tone control data such as a timbre number and a volume value, respectively. The CPU 10 accesses this RAM 12 via the system bus 20.

The control panel 13 is used to allow a user to instruct the electronic musical instrument about various operations. The control panel 13 comprises a display unit 13A, various switches (MODE switch 13B, EXIT switch 13C and CURSOR switch, etc.) and a dial 13E. Although various indicators and switches (not shown) are provided on the control panel 13 in addition to those mentioned above, they are not directly concerned with the present invention so that their description will not be given below.

The display unit 13A is used to display information indicating the current status of the electronic musical instrument and various messages. This display unit 13A may be constituted of a character display unit comprising an LCD, for example. The numeral, character, symbol, etc., which are displayed on the display unit 13A, correspond to the data sent from the CPU 10. This display unit 13A is also used to input various parameters in cooperation with the CURSOR switch 13D and dial 13E, which will be described later.

The switch means of the present invention comprises the MODE switch 13B and the EXIT switch 13C. The MODE switch 13B is used to change the electronic musical instrument to the interrupt mode from the normal mode. The interrupt mode permits the control panel 13 to function separately from the tone generator 15. In the interrupt mode, the tone generator 15 will not be affected at all even if the control panel 13 is operated. But, the tone control data, which is produced by operating the control panel 13, is converted to a MIDI message and is then sent outside the electronic musical instrument.

The normal mode permits the control panel 13 and the tone generator 15 to function in an interlocked fashion. In the normal mode, operating the control panel 13 will affect the tone generator 15 and the tone control data produced by the operation of the control panel 13 will be sent outside the electronic musical instrument after being converted to a MIDI message.

When a timbre number is input from the control panel 13 in a normal mode, for example, the tone generator 15 is set to generate a musical tone with the timbre corresponding to that timbre number. This will be accomplished by replacing the timbre number in the timbre buffer with the timbre number input through the control panel 13. At the same time, a program change message (MIDI message) including the timbre number which has been input through the control panel 13 is sent outside the electronic musical instrument. When a timbre number is input in the interrupt mode, however, the tone generator 15 will not be affected at all. That is, the content of the timbre buffer is not altered, so that the tone generator will keep generating musical tones based on the already-set timbre number while a program change message including the input timbre number is sent outside the electronic musical instrument.

Although the switch means of the present invention is constituted of two switches, namely the MODE switch 13B and the EXIT switch 13C, it may be constituted of a single switch. In this case, the switch should be designed to change the operation mode to the interrupt mode from the normal mode or vice versa every time it is depressed. This design is advantageous in that it can reduce the number of required switches.

The panel operators of the present invention for generating tone control data include the CURSOR switch 13D and the dial 13E. The CURSOR switch 13D is used to move the cursor that is displayed in an input field formed on the display unit 13A. When a parameter is given to a predetermined function, for example, plural pairs of function names and input fields for inputting the values associated with the function names are displayed on the display unit 13A. In this case, the cursor will be displayed in any one of the input fields. The CURSOR switch 13D is also used to move the cursor between the individual input fields. The position of the cursor indicates the currently selected function.

The dial 13E is used to input a value in each input field formed on the display unit 13A. This dial 13E is constituted of, for example, a rotary encoder which outputs data according to the rotational position. For instance, turning the dial 13E rightward increases the value of the data output from the dial 13E and turning the dial 13E leftward decreases the value of that data.

Although the panel operators constituted of the CURSOR switch 13D and the dial 13E are used to input various parameters in the electronic musical instrument in this embodiment, the panel operators may be constituted of discrete switches. For instance, instead of inputting a timbre number to select an associated timbre by using the CURSOR switch 13D and the dial 13E, a plurality of timbre switches corresponding to various timbres may be provided so that a timbre will be selected by depressing one of the timbre switches. In this case, a timbre number corresponding to the depressed timbre switch is generated and is stored in the timbre buffer.

The control panel 13 is connected to the CPU 10 via a panel scan circuit (not shown). The panel scan circuit scans the individual switches on the control panel 13 and forms panel data, which includes switch data consisting of a train of bits indicating the ON/OFF status of each switch and dial data. This panel data is sent via the system bus 20 to the CPU 10. The panel data is then stored in the RAM 12 under the control of the CPU 10, and is used to determine if a panel event has occurred. (The details will be given later.)

The keyboard 14 comprises a plurality of keys for allowing the user to instruct intervals of musical tones, a plurality of key switches whose opening or closing is interlocked with the operation of those keys, and a key scan circuit. The keyboard operators comprises a plurality of the keys and a plurality of the key switches. The key scan circuit scans the individual key switches and forms key data consisting of a train of bits indicating the ON/OFF status of each key. This key data is sent to the CPU 10 and is then stored in the RAM 12 under the control of the CPU 10. The key data stored in the RAM 12 is used to determine if a keyboard event has occurred. Based on the key data, keyboard data instructing tone ON or tone OFF is produced. (The details will be given later.)

The tone generator 15 generates a tone signal in accordance with predetermined data sent from the CPU 10. Connected to this tone generator 15 is a wave memory (not shown) in which plural pieces of waveform data, which have undergone pulse code modulation (PCM) and correspond to a plurality of timbres, are stored.

The tone generator 15 has a plurality of oscillators which can function simultaneously. The oscillators are selectively assigned for tone generation by an assigner in accordance with the tone-On instruction from the CPU 10. Any oscillator assigned for tone generation reads out the waveform data from the wave memory, and adds an envelope to the waveform data to generate a tone signal. The tone signal generated by each oscillator of the tone generator 15 is supplied to an amplifier 16.

The amplifier 16 is of a known type which amplifies the received tone signal by a given amplification factor. The tone signal amplified by the amplifier 16 is sent to a loudspeaker 17 of a known type, which converts the tone signal as an electric signal into an acoustic signal. Through the loudspeaker 17, musical tones associated with the depression/release of the keys on the keyboard 14 or the musical tones associated with an automatic performance are sounded.

The operation of the electronic musical instrument according to this embodiment with the above-described structure will now be described in detail with reference to flowcharts given from FIGS. 3 to 4.

Figure 3:
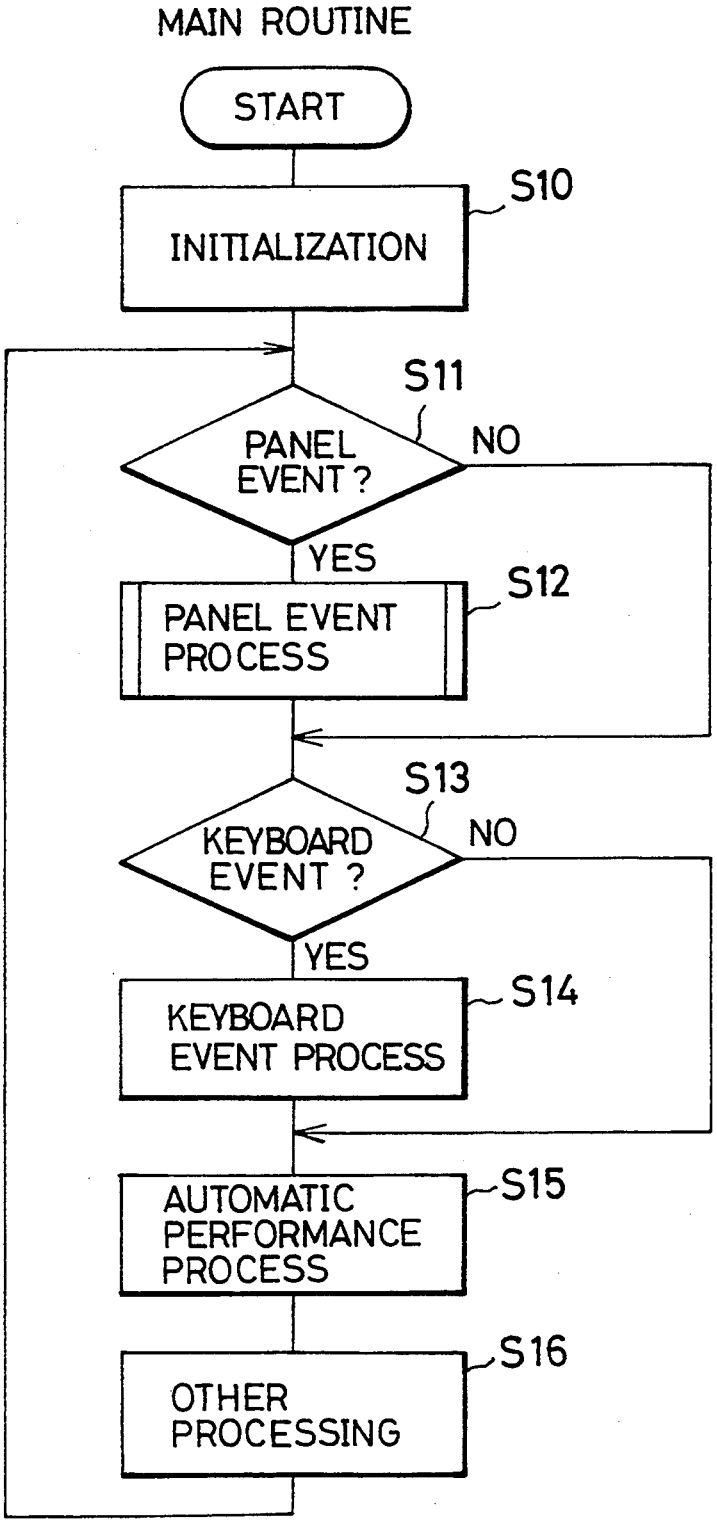
FIG. 3 is a flowchart (main routine) illustrating the operation of the embodiment.
Figure 4:
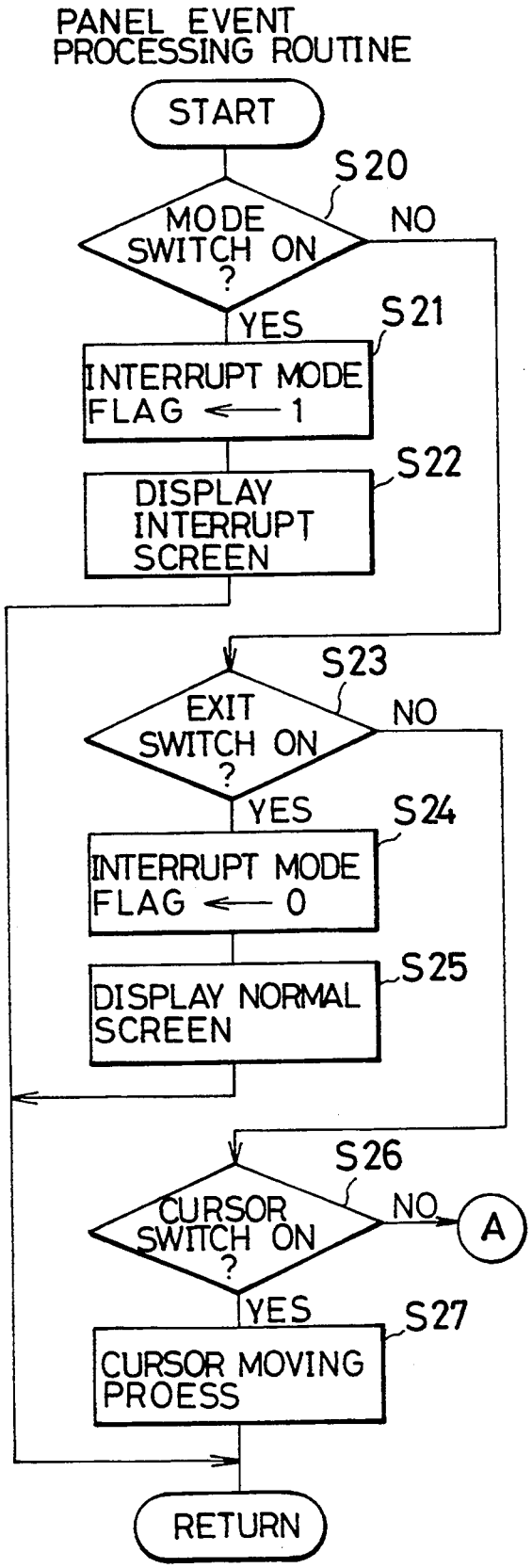
FIG. 4 and FIG. 5 are flowcharts (panel event processing routine) illustrating the operation of the embodiment.

FIG. 3 presents the flowchart which shows the main routine of the electronic musical instrument according to this embodiment. This main routine will be invoked when the instrument is powered on.

Upon power on, initialization is executed first (step S10). In this initialization, the registers and flags in the CPU 10 are cleared, initial values are set to various types of buffers, registers, flags, etc. defined in the RAM 12, and initial data is set to the tone generator 15 to suppress the generation of undesired tones.

Next, it is checked if there is any panel event (step S11). This check is executed in the following manner. First, the panel scan circuit of the control panel 13 scans the switches 13B to 13D and obtains panel data, consisting of the switch data indicating the ON/OFF status of each of the switches 13B–13D and the dial data according to the set position of the dial 13E. (This panel data will be hereinafter called "new panel data.")

Then, the new panel data is compared with panel data previously obtained and already stored in the RAM 12 (hereinafter called "old panel data"). If there is an unmatched bit found between the new panel data and the old panel data, a panel event map of train of bits, each of which corresponding to the unmatched bit is set on, is prepared. When there is an ON-state bit in this panel event map, it is determined that a panel event has occurred.

When it is determined in step S11 that a panel event has occurred, a panel event process is performed (step S12). The details of this panel event process will be given later. When it is determined in step S11 that no panel event has occurred, step S12 is skipped.

Next, it is checked if there is any keyboard event (step S13). This check is executed in the following manner. First, the key scan circuit of the keyboard 14 scans the key switches and obtains key data indicating the ON/-OFF status of each key (hereinafter called "new key data") as a train of bits corresponding to each key.

Then, the new key data is compared with key data previously obtained and already stored in the RAM 12 (hereinafter called "old key data"). If there is an unmatched bit found between new key data and the old key data, a key event map of a train of bits, each of which corresponding to the unmatched bit is set on, is prepared. When there is an ON-state bit in this key event map, it is determined that a keyboard event has occurred.

When it is determined in step S13 that a keyboard event has occurred, a keyboard event process is performed (step S14). In the keyboard event process, when the occurrence of a keyboard ON event is detected, a tone ON process is executed. In the tone ON process, first, an oscillator in the tone generator 15 is assigned by the assigner to generate the tone signal that is associated with the depressed key.

Then, the keyboard data, which includes a key number indicating the key which has been depressed and touch data indicating the strength (speed) of the key depression, and tone control data, which includes a timbre number and a volume value, are produced and sent to the tone generator 15. Based on those received data, the assigned oscillator in the tone generator 15 produces a tone signal, which will be sent via the amplifier 16 to the loudspeaker 17 to be generated as a musical tone.

In parallel to the above-described tone ON process, a note ON message including the key number of the ON-event key and the touch data of that key is prepared and is sent via the MIDI interface circuit 18 to an external device.

In the keyboard event process, when the occurrence of a keyboard OFF event is determined, on the other hand, a tone OFF process is performed. In the tone OFF process, the oscillator in the tone generator 15 which is assigned to the OFF-event key is detected and the release envelope data is sent to this oscillator to set the tone off.

In parallel to the above-described tone OFF process, a note OFF message including the key number of the OFF-event key is prepared and is sent via the MIDI interface circuit 18 to the external device.

In connecting a sequencer to the MIDI interface circuit 18 of this electronic musical instrument and recording a MIDI message in the sequencer, the sequencer receives and sequentially stores MIDI messages (note-ON or note-OFF messages), which are produced in the tone ON process or tone OFF process in the keyboard event process and are output via the MIDI interface circuit 18.

When this keyboard event process is terminated or it is determined in the aforementioned step S13 that no keyboard event has occurred, an automatic performance process is then executed (step S15).

In the automatic performance process, when this electronic musical instrument is in an automatic performance mode and when the timing for tone ON or tone OFF has arrived, a tone ON process or tone OFF process is performed in accordance with automatic performance data read out from the ROM 11. In the tone ON process or tone OFF process in this automatic performance process, the automatic performance data stored in the ROM 11 is used instead of the aforementioned keyboard data or the tone control data involved in the keyboard event process. When the automatic performance data read out from the ROM 11 is special data indicating the end of an automatic performance, or when the automatic performance mode is released, the automatic performance will be stopped.

Next, an other processing is executed (step S16). This "an other processing" includes a process for transmission and reception of a MIDI message, for example. Thereafter, the flow returns to step S11 to repeat the above-described sequence of processes. When a panel event originated from the panel operation or a keyboard event originated from the keyboard operation occurs during the repetitive execution of steps S11 to S16, the process associated with that event is carried out. In this manner, the individual functions of the electronic musical instrument are accomplished.

Figure 5:
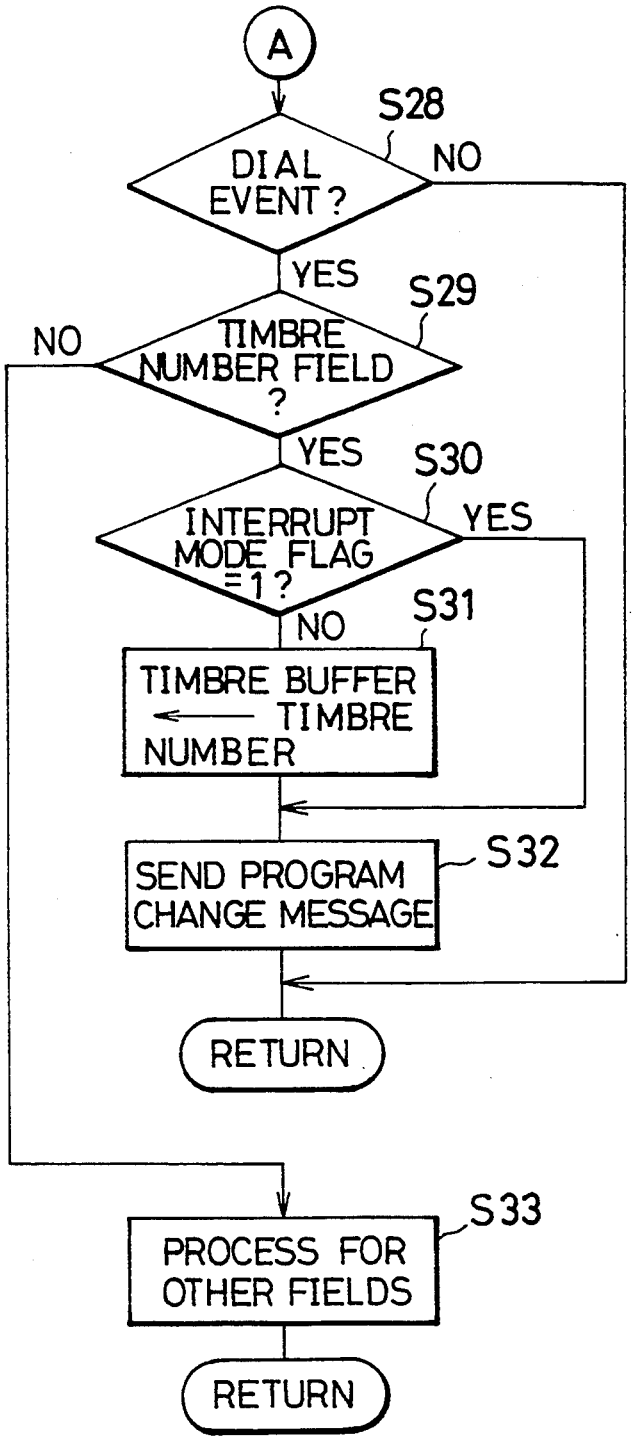
Figure 6:
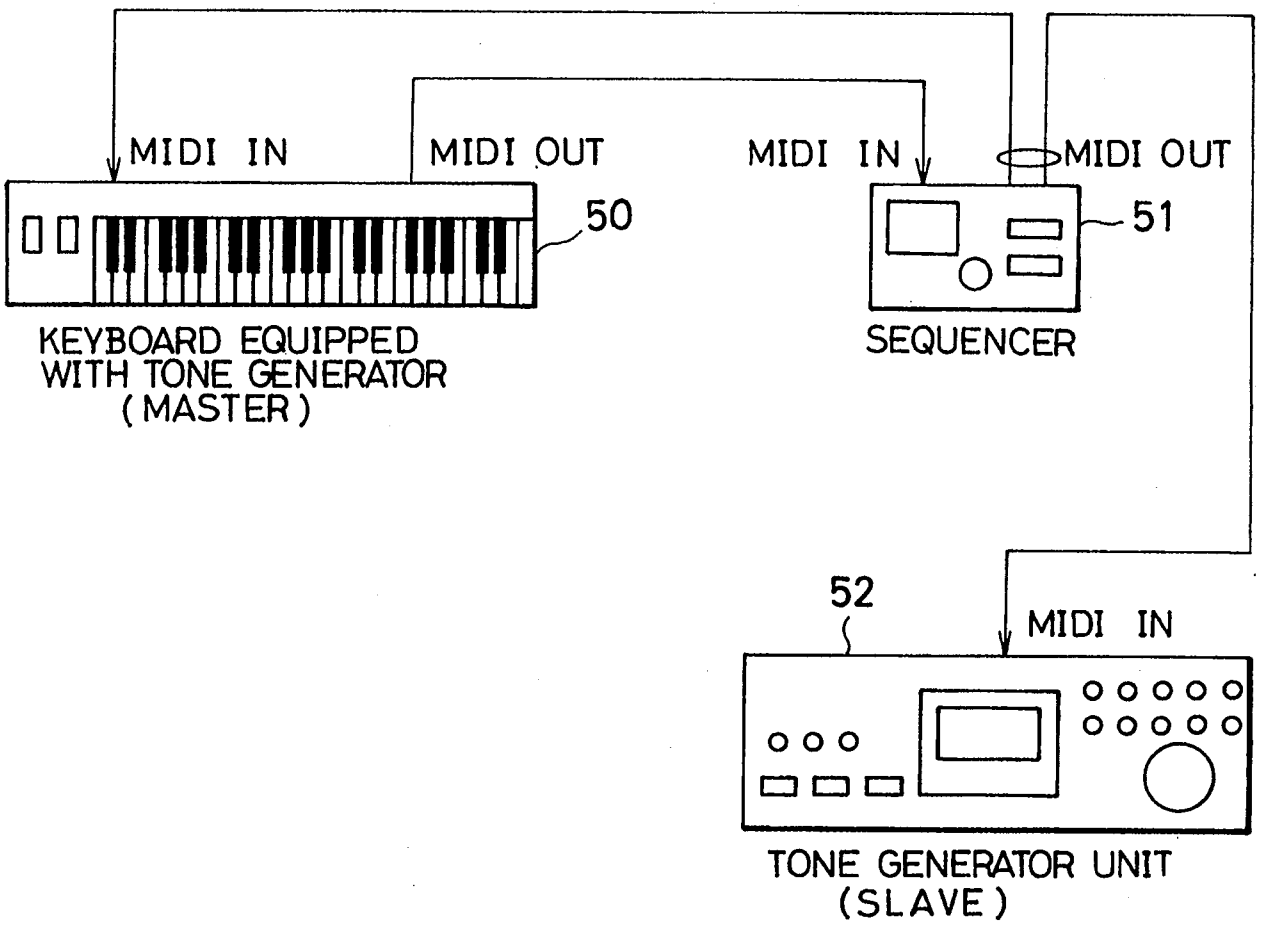
FIG. 6 is a diagram for explaining over dubbing.

The details of the panel event process will now be given with reference to the flowchart in FIGS. 4 and 5.

In the panel event process, it is checked first whether there is an ON event of the MODE switch 13B (step S20). This is accomplished by checking if bits in the panel event map and new panel data, which correspond to the MODE switch 13B, are both set on.

When it is determined in step S20 that an ON event of the MODE switch 13B has occurred, an interrupt mode flag is set to "1" (step S21). The interrupt mode flag is defined in the RAM 12 and is used to memorize whether this electronic musical instrument is in an interrupt mode or a normal mode. This interrupt mode flag is set to "1" when this electronic musical instrument is in an interrupt mode and is cleared to "0" when the instrument is in a normal mode.

Then, an interrupt screen is displayed on the display unit 13A (step S22). This interrupt screen allows the user to input a parameter to send a MIDI message outside the electronic musical instrument. With this interrupt screen displayed, the user can send out a desired MIDI message by operating the CURSOR switch 13D and the dial 13E. The steps S20 to S21 accomplish the function of the switch means of the present invention (switching from the normal mode to the interrupt mode). When the display of the interrupt screen is terminated, the flow returns to the main routine from the panel event processing routine.

If it is determined in the aforementioned step S20 that there is no ON event of the MODE switch 13B, it is then checked whether there is an ON event of the EXIT switch 13C (step S23). This is accomplished by checking if bits in the panel event map and new panel data, which correspond to the EXIT switch 13C, are both set on.

When it is determined in step S23 that an On event of the EXIT switch 13C has occurred, the interrupt mode flag is cleared to "0" (step S24). Then, a normal screen is displayed on the display unit 13A (step S25). The steps S23 to S25 accomplish the function of the switch means of the present invention (switching from the interrupt mode to the normal mode).

The normal screen allows the user to input various parameters in the normal mode. With this normal screen displayed, the user can input parameters operating the dial 13E to alter the timbre, volume and so forth. When a parameter is input in the normal mode, this parameter is converted to a MIDI message which in turn will be sent outside the electronic musical instrument. For example, when a parameter to alter the timbre is input, a program change message as a MIDI message is produced and is sent outside the electronic musical instrument. When the display of the normal screen is terminated, the flow returns to the main routine from the panel event processing routine.

If it is determined in the aforementioned step S23 that there is no ON event of the EXIT switch 13C, it is then checked whether there is an ON event of the CURSOR switch 13D (step S26). This is accomplished by checking if bits in the panel event map and new panel data, which correspond to the CURSOR switch 13D, are both set on.

If it is determined that an ON event of the CURSOR switch 13D has occurred, a cursor moving process is executed (step S27). The cursor moving process moves the cursor displayed in one input field on the display unit 13A to the next input field thereon. This cursor moving process will be performed every time an ON event of the CURSOR switch 13D occurs, regardless of the normal mode or the interrupt mode. When the cursor moving process is terminated, the flow returns to the main routine from the panel event processing routine.

If it is determined in the aforementioned step S26 that there is no ON event of the CURSOR switch 13D, it is then checked if there is a dial event (step S28). This is accomplished by checking if each dial data included in the new panel data differs from associated dial data included in the old panel data. If there is unmatched dial data, it is determined that a dial event has occurred. When it is determined in step S28 that no dial event has occurred, the flow returns to the main routine from the panel event processing routine.

When it is determined in step S28 that a dial event has occurred, it is then checked if the cursor is currently positioned in the timbre-number input field (step S29). This is accomplished by checking the relation between the type of the current screen displayed on the display unit 13A and the current position of the cursor. When it is determined that the cursor is present in the timbre-number input field, it is then checked if the interrupt mode flag is "1," i.e., if the electronic musical instrument is in an interrupt mode (step S30). When it is determined that the operation mode is the normal mode, not the interrupt mode, the input timbre number (dial data in the new panel data) is stored in the timbre buffer (step S31).

The timbre buffer is used to store the timbre number (one piece of tone control data) currently in use. At the time a tone generation instruction is given to the tone generator 15, the timbre is determined referring to the content of this timbre buffer.

Then, a process for transmitting a program change message is executed (step S32). More specifically, a program change message including the input timbre number is prepared and is sent outside the electronic musical instrument via the MIDI interface circuit 18.

In the normal mode, as described above, when the user operates the control panel 13 to change the timbre number, the altered timbre number is set in the timbre buffer and the timbre of musical tones to be generated by this electronic musical instrument is changed to the timbre associated with the timbre number newly set in the timbre buffer. The changed timbre number is sent outside this instrument as a part of the program change message.

When it is determined in step S30 that the interrupt mode flag is "1," i.e., the operation mode is the interrupt mode, the flow jumps over the next step S31 to step S32 where the aforementioned process for transmitting a program change message is executed. Those steps S30 and S31 accomplish the function of the control means.

Even if the user operates the control panel 13 to change the timbre number when this electronic musical instrument is in the interrupt mode, the changed timbre number will not be set in the timbre buffer. Accordingly, the timbre of musical tones in the electronic musical instrument will not be changed, but conforms to the timbre number previously set in the timbre buffer. The changed timbre number will however be sent outside the electronic musical instrument as a part of the program change message. This processing accomplishes the function to output only a MIDI message outside the electronic musical instrument without affecting the tone generator 15 in an interrupt mode.

When it is determined in the aforementioned step S29 that the current cursor position is not in the timbre-number input field, a process for other fields is executed (step S33). This "process for other fields" includes a process for changing parameters associated with a channel pressure, a control change and other MIDI messages. Since the process for other fields is accomplished in nearly the same way as done for the above-described timbre-number changing process, the details will not be given.

According to this embodiment, as described above, when the electronic musical instrument is set in a normal mode by the operation of the EXIT switch 13C, the timbre number produced by the operation of the dial 13E on the control panel 13 is sent to the timbre buffer provided in the RAM 12 to be stored there. When the electronic musical instrument is set in an interrupt mode by the operation of the MODE switch 13B, on the other hand, the timbre number produced by the operation of the dial 13E on the control panel 13 is inhibited from being sent to the timbre buffer. The timbre number stored in the timbre buffer will not therefore be altered even if the dial 13E is operated. This means that in the interrupt mode, even the operation of the dial 13E to change the timbre number will not affect the tone generator 15 at all. When a program change message is produced by the operation of the dial 13E, this message is sent outside the electronic musical instrument via the MIDI interface circuit 18, irrespective of whether the electronic musical instrument is in an interrupt mode or a normal mode.

When the dial 13E is operated in the interrupt mode, therefore, a program change message associated with that operation of the dial 13E can be sent outside the electronic musical instrument without affecting the tone generator 15. Even in the case where musical tones are being generated based on the received MIDI message, when the electronic musical instrument is set in an interrupt mode, a desired program change message can be sent outside the electronic musical instrument, regardless of the musical tones that are generated by the tone generator 15. The electronic musical instrument of the present invention is therefore excellent in operability.

Although the foregoing description of this embodiment has been given with reference to the case where a program change message for defining a timbre is sent outside the electronic musical instrument as one example of the tone control data, the present invention may also be adapted for the case of sending other tone control data including various pieces of information such as the volume and pan-pot defined by the MIDI standards.

Although the transmission data prepared in conformity to MIDI standards is sent outside the electronic musical instrument in the above-described embodiment, various types of transmission data may also be sent outside the electronic musical instrument.

Although the normal screen and the interrupt screen are selectively displayed on the display unit 13A in the above-described embodiment, both screens may be displayed simultaneously if the display unit 13A has a large screen like a CRT.

In short, the present invention will provide an electronic musical instrument with an excellent operability, which can independently send a MIDI message outside the electronic musical instrument to alter the status of an external tone generator without affecting a tone generator incorporated in the electronic musical instrument.

What is claimed is:

1. An electronic musical instrument comprising:

keyboard operators for generating keyboard data;

panel operators for generating tone control data;

memory means for storing said tone control data;

switch means for changing a normal mode to an interrupt mode, and vice versa;

control means for, when tone control data is produced in accordance with an operation of said panel operators, writing said tone control data into said memory means in said normal mode, and inhibiting said tone control data from being written into said memory means in said interrupt mode;

a tone generator for, when keyboard data is produced in accordance with an operation of said keyboard operators, producing a tone signal based on said keyboard data and said tone control data stored in said memory means; and transmission means for generating transmission data according to tone control data when the tone control data is produced in accordance with an operation of said panel operators, and transmitting said transmission data outside said electronic musical instrument, and for generating transmission data according to keyboard data when the keyboard data is produced in accordance with an operation of said keyboard operators, and transmitting said transmission data outside said electronic musical instrument.

2. The electronic musical instrument according to claim 1, wherein said transmission data is a MIDI message prepared in conformity to MIDI standards.

3. The electronic musical instrument according to claim 1, wherein said tone control data produced in accordance with an operation of said panel operators is data for instructing a timbre change, and said transmission means produces transmission data for instructing a timbre change based on said tone control data, and transmits the transmission data outside said electronic musical instrument.

4. The electronic musical instrument according to claim 3, wherein said transmission data generated by said transmission means is a program change message prepared in conformity to MIDI standards.

5. The electronic musical instrument according to claim 1, wherein said switch means comprises a switch for changing said normal mode to said interrupt mode, and a switch for changing said interrupt mode to said normal mode.

6. The electronic musical instrument according to claim 1, wherein said switch means comprises a switch for changing said normal mode to said interrupt mode or said interrupt mode to said normal mode.

7. The electronic musical instrument according to claim 1, wherein said control means is a central processing unit.

8. The electronic musical instrument according to claim 1, wherein said transmission means comprises a central processing unit and a MIDI interface circuit for transmitting a MIDI message.

* * * * *

UNITED STATES PATENT AND TRADEMARK OFFICE

CERTIFICATE OF CORRECTION

PATENT NO. : 5,414,209

DATED : May 9, 1995

INVENTOR(S) : Shigehiro MORITA

It is certified that error appears in the above-indentified patent and that said Letters Patent is hereby corrected as shown below:

On the title page:
After [22] Filed: Mar. 1, 1994, insert
--[30] Foreign Application Priority Data
March 9, 1993 [JP] Japan .....72802/93--

Signed and Sealed this

Twenty-seventh Day of February, 1996

Bruce Lehman

*Attest:*

BRUCE LEHMAN

*Attesting Officer*

*Commissioner of Patents and Trademarks*